US006498443B2

(12) United States Patent
Ueda et al.

(10) Patent No.: US 6,498,443 B2
(45) Date of Patent: Dec. 24, 2002

(54) COLOR TV TUBE APPARATUS AND COLOR DISPLAY TUBE APPARATUS

(75) Inventors: Yasuyuki Ueda, Hirakata (JP); Masayuki Isayama, Kumamoto (JP); Katsuhisa Kitada, Mino (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/874,824

(22) Filed: Jun. 5, 2001

(65) Prior Publication Data

US 2002/0017872 A1 Feb. 14, 2002

(30) Foreign Application Priority Data

Jun. 15, 2000 (JP) ..... 2000-180503

(51) Int. Cl.[7] ..... H01J 29/56
(52) U.S. Cl. ..... 315/368.11; 315/370; 315/382
(58) Field of Search ..... 315/368.11, 368.24–368.28, 315/364, 370, 380, 382, 394, 398

(56) References Cited

U.S. PATENT DOCUMENTS 4,689,525 A * 8/1987 Shimoma et al. ..... 315/370
4,701,677 A * 10/1987 Ashizaki et al. ..... 315/382
4,728,859 A * 3/1988 Natsuhara et al. ..... 315/15

FOREIGN PATENT DOCUMENTS

JP 9-265922 10/1997

* cited by examiner

*Primary Examiner*—Don Wong
*Assistant Examiner*—Wilson Lee
(74) *Attorney, Agent, or Firm*—Price and Gess

(57) ABSTRACT

A color TV tube apparatus having a horizontal deflection coil for generating a pincushion-shaped horizontal deflection field, which uses a self-convergence method. In such a color TV tube, the horizontal deflection coil is adjusted so that the vertical focus points of the electron beams lie 50 mm or less on the inside and 30 mm or less on the outside of each edge of the effective display screen area along the horizontal axis. The horizontal deflection coil is adjusted with the focusing of an electron beam by a lensing action of an electron gun non-operational.

16 Claims, 12 Drawing Sheets

FIG.12

| Screen Size | Aspect Ratio | Maximum Deflection Angle | Electromagnetic Focus Point Positioning |
|---|---|---|---|
| 36 | 16 : 9 | 124° | 32～35mm |
| 32 | 16 : 9 | 124° | 18～20mm |
| 28 | 16 : 9 | 124° | 3～5mm |

COLOR TV TUBE APPARATUS AND COLOR DISPLAY TUBE APPARATUS

BACKGROUND OF THE INVENTION

1. Field of the Invention

The present invention relates generally to color cathode ray tube (CRT) apparatus used in televisions and computer monitors, and more particular to improving the image quality of color CRT apparatus having a shortened depth by widening the maximum deflection angle.

2. Related Art

In recent years, increases in the screen size of color CRT apparatus used as televisions and computer monitors have seen a parallel demand for a reduction in the overall depth of the apparatus (hereafter, a color CRT apparatus having a horizontal deflection cycle of less than 70 kHz will be referred to as a "color TV tube apparatus" and a color CRT apparatus having a horizontal deflection cycle of 70 kHz or more will be refer to as a "color display tube apparatus"). Since manufactures are seeking to stay within the 450 mm standard depth of residential furniture, there has been a particular focus on reducing the depth of apparatus of 28 inches or larger in diagonal size, i.e., those apparatus of a size that up until now have tended to exceed this standard depth. The sought after reduction in the depth of color CRT apparatus can be achieved by widening the maximum deflection angle of the apparatus.

The maximum deflection angle is defined as the angle of an electron beam at the deflection center opened up towards the phosphor screen when the entire surface of the screen is scanned. FIG. 1 is a perspective view of a color CRT apparatus 1 from the rear. In FIG. 1, the maximum deflection angle is the angle AOB, formed by diagonals A and B, originating at a phosphor screen 2 and meeting at a deflection center O. Consequently, a reduction in the depth of the color CRT apparatus 1 can be achieved by widening this maximum deflection angle AOB.

The maximum deflection angle referred to herein is calculated by doubling the largest value of the deflection angle. The deflection angle is the angle created when an electron beam emitted within a color CRT from an electron gun is deflected from a linear path by a deflection field, i.e., it is the angle opened up between the linear path and the path of the deflected electron beam.

Self-convergence, which is now standard in color CRT apparatus, corrects convergence of the three electron beams by distorting the deflection field generated by a deflection coil. Self-convergence results in the vertical deflection field being distorted into a barrel shape and the horizontal deflection field being distorted into a pincushion shape. The distortion of the horizontal deflection field becomes more pronounced as the maximum deflection angle widens.

The electron beams remain out of focused under conditions of self-convergence because of the focusing action effected on the electron beams by the horizontal deflection field (hereafter, "electromagnetic focusing effect"). Japanese Laid-Open Patent No. 61-99249 notes that this effect can be overcome by using a DAF (Dynamic Astigmatism & Focus correction) electron gun to correct focusing.

However, the fact remains that existing technology has not yet been able to satisfactorily correct for the pronounced electromagnetic focusing effect occurring in apparatus over a certain size with a wide maximum deflection angle (hereafter, such apparatus will be referred to as "wide-screen/short-depth type" apparatus).

This has meant that, to date, there have been no color TV tube apparatus of 28 inches or larger available which have a 16:9 aspect ratio and a maximum deflection angle of 110° or greater, or a 4:3 aspect ratio and maximum deflection angle of 114° or greater, and no color display tube apparatus available having a maximum deflection angle of 104° or greater. However, it is high time that wide-screen/short-depth type color CRT apparatus of greater size and maximum deflection angle were made available. The development of convergence technology is a necessary condition for this to happen.

SUMMARY OF THE INVENTION

The present invention seeks to make available wide-screen/short-depth type color CRT apparatus having a high-quality image that optimizes both the focusing and convergence of the electron beams.

The objectives of the present invention can be achieved by a color TV tube apparatus of 28 inches or larger in diagonal size, having a maximum deflection angle of 115° or greater and less than 180°, and which uses a self-convergence method; the color TV tube apparatus comprises a color TV tube, an electron gun, a deflection yoke - mounted on a funnel part of the color TV tube and having a horizontal deflection coil for generating a pincushion-shaped horizontal deflection field, wherein the horizontal deflection coil is adjusted so that a vertical focus point of an electron beam lies 50 mm or less on the inside and 30 mm or less on the outside of each edge of the effective display screen area along the horizontal axis with a focusing of an electron beam by a lensing action of the electron gun non-operational - and a convergence correction coil mounted on a neck part of the color TV tube and functioning to correct convergence.

The objectives of the present invention can also be achieved by a color display tube apparatus of 17 inches or larger in diagonal size, having a maximum deflection angle of 105° or more and less than 180°, and which uses a self-convergence method; the color display tube apparatus comprises a color TV tube, an electron gun, a deflection yoke—mounted on a funnel part of the color TV tube and having a horizontal deflection coil for generating a pincushion-shaped horizontal deflection field, wherein the horizontal deflection coil is adjusted so that a vertical focus point of an electron beam lies 20 mm or less on the inside and 50 mm or less on the outside of each edge of the effective display screen area along the horizontal axis with a focusing of an electron beam by a lensing action of the electron gun non-operational—and a convergence correction coil mounted on a neck part of the color TV tube and functioning to correct convergence.

In accordance with the above-stated conditions, wide-screen/short-depth type color CRT apparatus with a high image quality that optimize both focusing and convergence and which are not susceptible to raster distortion will be realizable.

BRIEF DESCRIPTION OF THE DRAWINGS

These and other objects, advantages and features of the invention will become apparent from the following description thereof taken in conjunction with the accompanying drawings that illustrate specific embodiments of the present invention.

In the drawings:

FIG. 12 is a table showing experiment data relating to the optimal positioning of electromagnetic focus points.

DESCRIPTION OF THE PREFERRED EMBODIMENTS

The following describes specific embodiments of a color CRT apparatus relating to the present invention with reference to the drawings.

Figure 1:
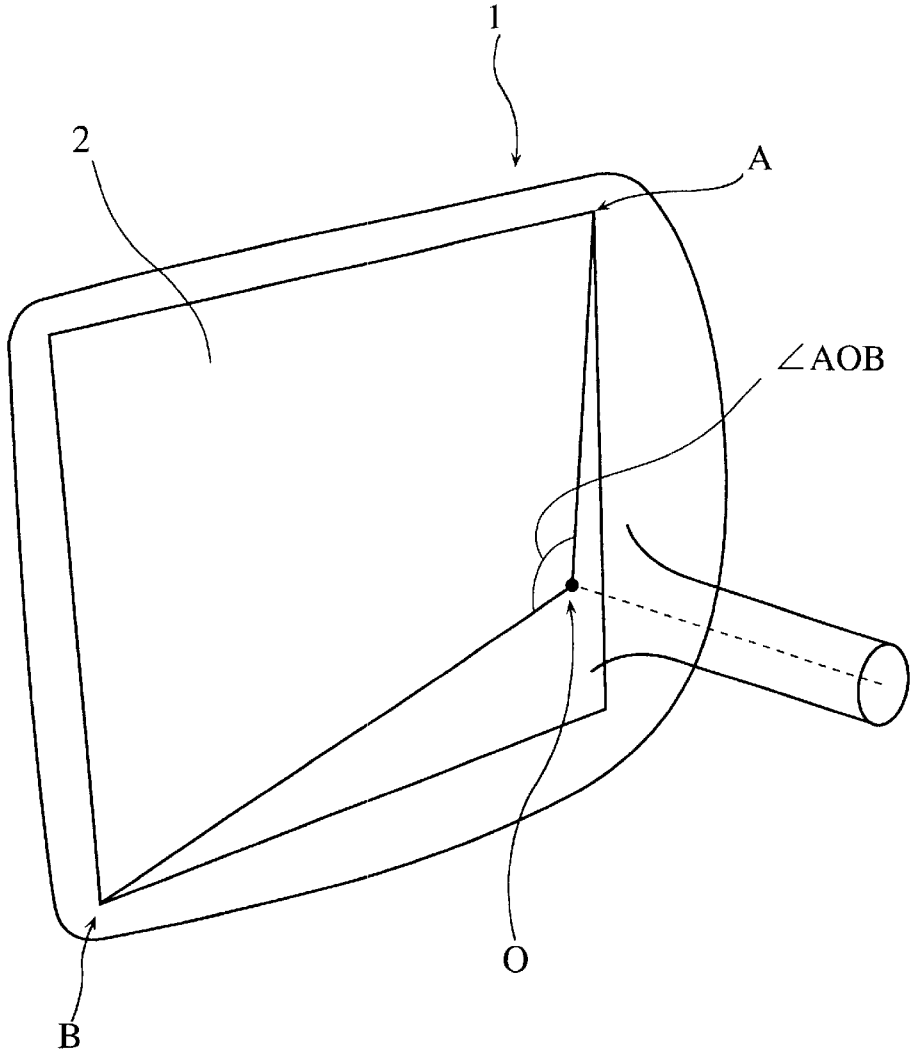
FIG. 1 is a perspective view of a color CRT apparatus from the rear.
Figure 2:
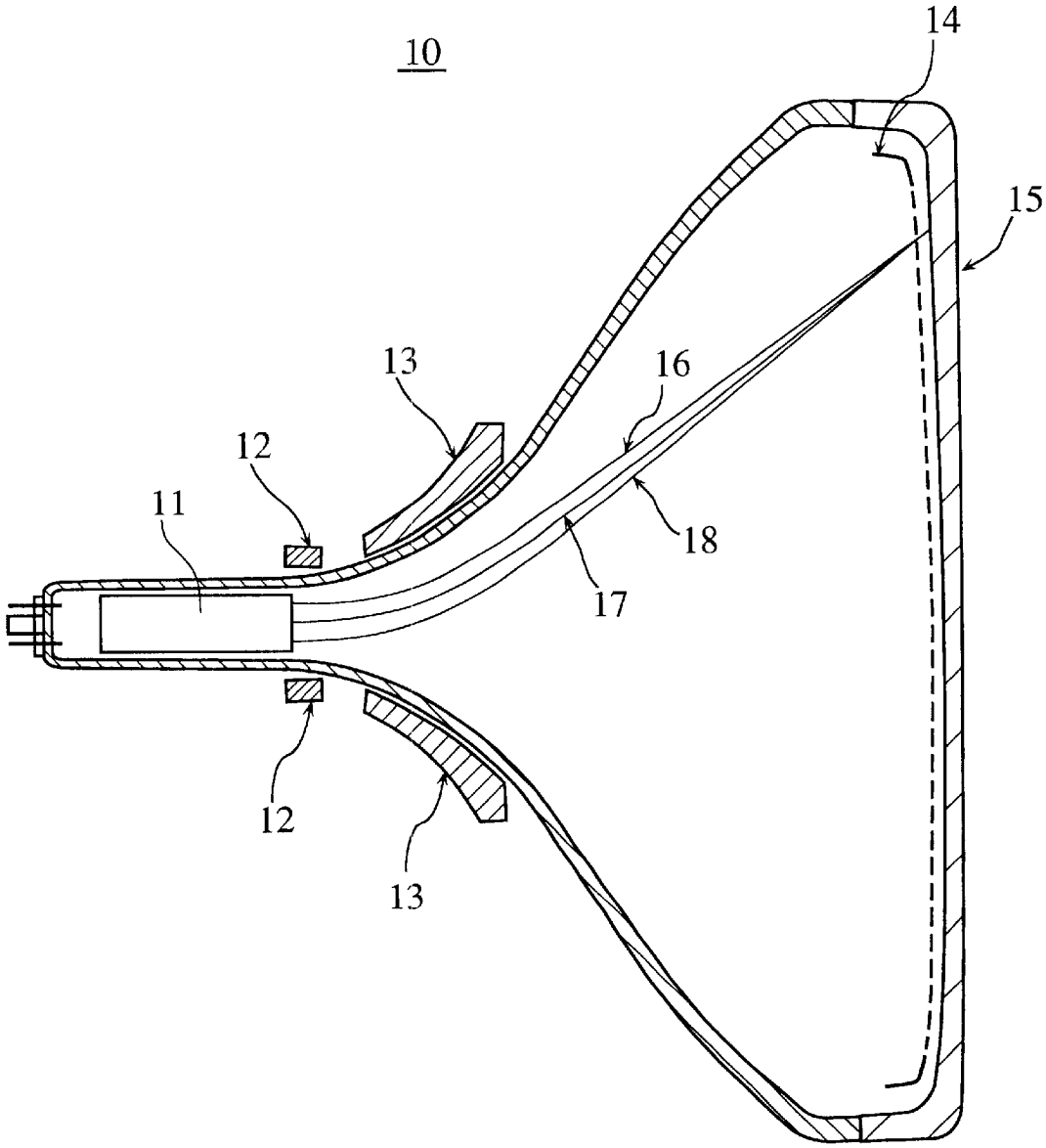
FIG. 2 is a horizontal cross-sectional view of the tube axis of a color TV tube apparatus, which is a specific embodiment of the present invention.

FIG. 2 is a horizontal cross-sectional view of the tube axis of a color TV tube apparatus, which is a specific embodiment of the present invention. The color TV tube apparatus 10 is a wide-screen/short-depth type color TV tube with a flat display screen (diagonal size of 32 inches; 16:9 aspect ratio; 124° maximum deflection angle) that has an in-line type electron gun 11 disposed in a neck part and a deflection coil 13 mounted on a funnel part. The electron beams 16–18 emitted from the in-line type electron gun 11 (hereafter "electron gun") are deflected by the deflection coil 13, pass through an aperture in a shadow mask 14, and reach a phosphor screen 15. The electron beams 16–18 are focused within the electron gun 11 by a lensing action and beam spots are formed on the phosphor screen 15. A convergence correction coil 12 (hereafter, "correction coil") and the deflection coil 13 function generally to correct the convergence of the electron beams 16–18, and more particularly, the correction coil 12 functions to correct any misconvergence remaining after the deflection coil 13 has corrected convergence.

Figure 3:
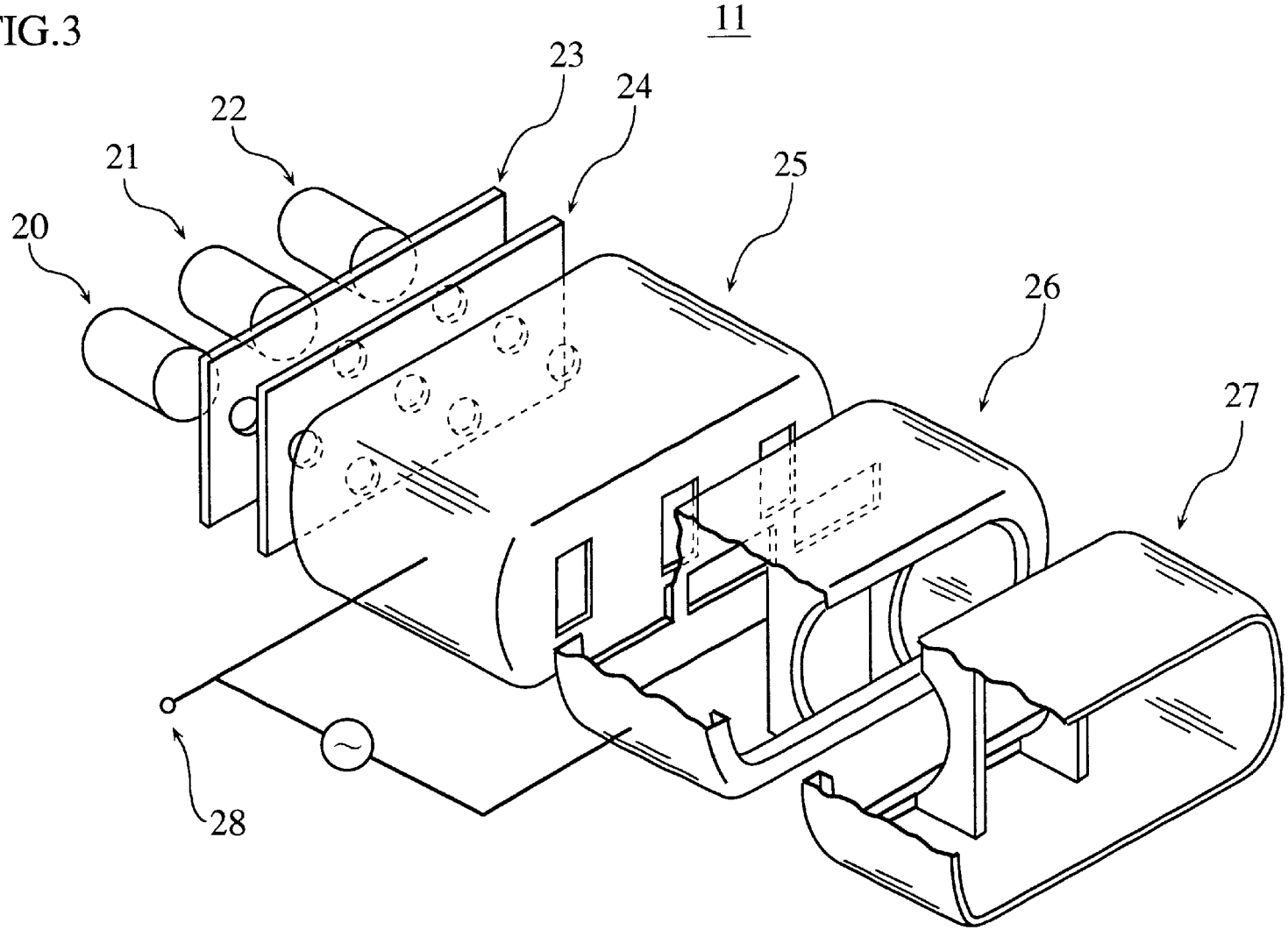
FIG. 3 is a perspective view of the electron gun of a color TV tube apparatus, which is a specific embodiment of the present invention.

The electron gun 11 is a DAF electron gun of the type mentioned above, and as illustrated in FIG. 3, it has a cathode base constructed from barium and other materials, and comprises cathodes 20–22 emitting electron beams corresponding to the colors red, green, and blue, a control grid electrode 23, an acceleration electrode 24, a first focusing electrode 25, a second focusing electrode 26, and a final electrode 27. The first focusing electrode 25 is applied with a predetermined voltage from a terminal 28 and functions to correct the focus at screen center. The second focusing electrode 26 is applied with a voltage that alters in synchronization with alterations in the deflection angle of the electron beams (hereafter, "dynamic focusing voltage"). In addition to correcting the focus around the periphery of the screen, it functions to generate a quadrupole lens, which arises from the difference in electric potential between the first focusing electrode 25 and the second focusing electrode 26, and to correct the shape of electron beam spots which have been distorted by electromagnetic focusing effect.

The deflection coil 13 comprises a vertical deflection coil, which deflects the electron beams onto the screen in a vertical direction, and a horizontal deflection coil, which deflects the electron beams onto the screen in a horizontal direction. The vertical deflection field generated by the vertical deflection coil is distorted into a barrel shape, while the horizontal deflection field generated by the vertical deflection coil is distorted into a pincushion shape. A common raster distortion correction circuit is connected to the vertical deflection coil for the purpose of correcting raster distortion.

Figure 4:
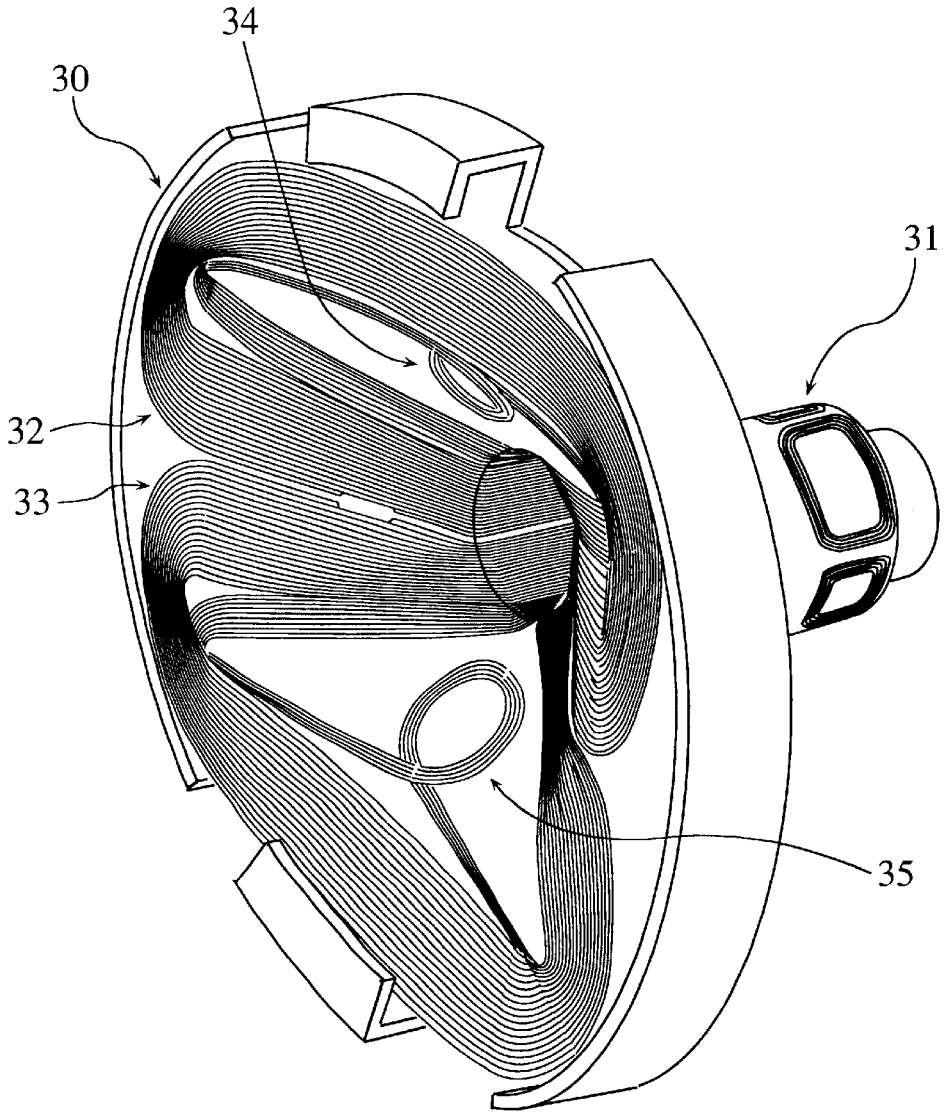
FIG. 4 is a perspective view of the deflection coils and the neck of a color TV tube apparatus, which is a specific embodiment of the present invention.

FIG. 4 is a perspective view of the deflection coils and the neck of the color TV tube, which is a specific embodiment of the present invention. In particular, FIG. 4 shows a horizontal deflection coil 30 and a correction coil 31 (equivalent to the correction coil 12 in FIG. 2). In FIG. 4, the horizontal deflection coil 30 comprises a pair of main coils 32 and 33, and a pair of auxiliary coils 34 and 35, each auxiliary coil 34 and 35 being positioned in a horizontally central part of one of the main coils 32 and 33 and connected electrically in series to the encompassing main coil. A pincushion-shaped deflection field is generated by these coils 32–35.

Figure 5C:
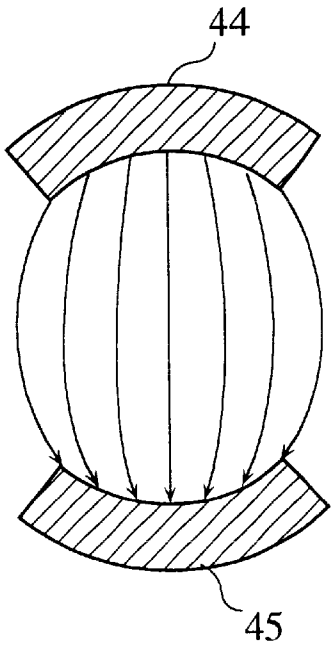
FIG. 5C illustrates a barrel-shaped deflection field generated by a pair of arc-shaped magnets.
Figure 5B:
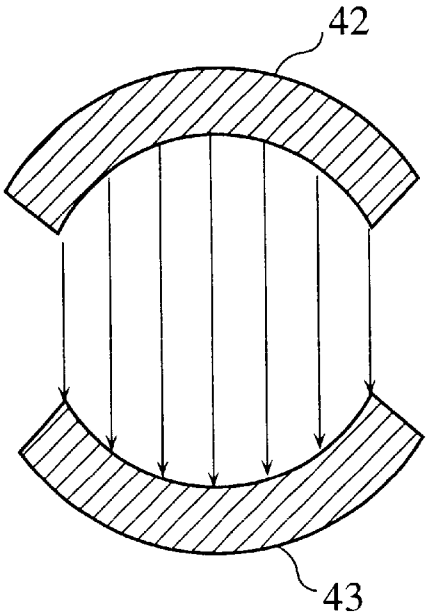
FIG. 5B illustrates a uniform deflection field generated by a pair of arc-shaped magnets.
Figure 5A:
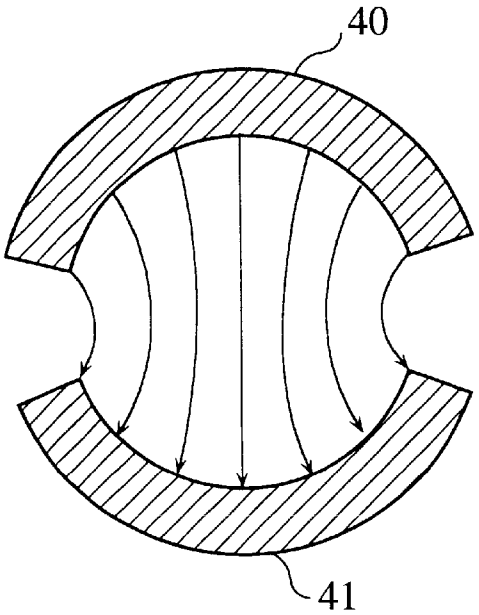
FIG. 5A illustrates a pincushion-shaped deflection field generated by a pair of arc-shaped magnets.

FIGS. 5A–5C is a diagram illustrating the magnetic flux generated by a pair of arc-shaped magnets when the magnets are placed opposite each other so as to form a circumference. In FIGS. 5A–5C, 40–45 are the arc-shaped magnets, wherein the pairings are 40 and 41, 42 and 43, 44 and 45. If the arc-shaped magnets are placed within a circumference, then when the arcs are lengthened, thus shortening the distance separating the magnets, the deflection field generated by the magnets is pincushion-shaped, as in FIG. 5A, and when the arcs are shortened, thus lengthening the distance separating the magnets, the deflection field generated by the magnets is barrel-shaped, as in FIG. 5C. The deflection field is uniform when the arcs are neither long nor short, as in FIG. 5B. Thus it becomes clear that in order to alleviate pincushion distortion occurring in the horizontal deflection field it is necessary to adjust the distance separating the main coils 32 and 33.

Figure 6:
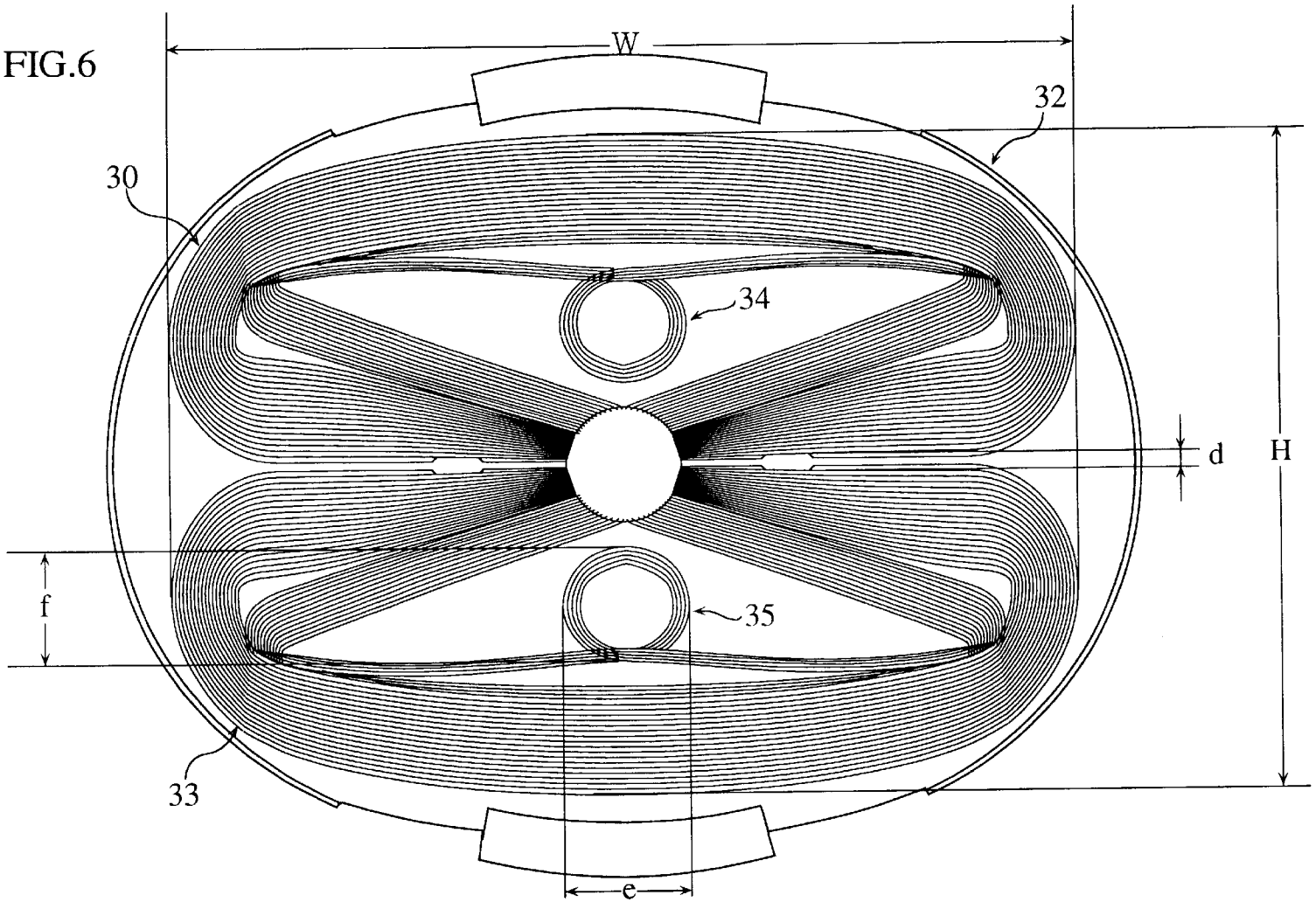
FIG. 6 is a frontal view of the horizontal deflection coil of a color TV tube apparatus, which is a specific embodiment of the present invention.

FIG. 6 is a frontal view of the horizontal deflection coil 30 of the color TV tube apparatus, which is a specific embodiment of the present invention. The main coils 32 and 33, which comprise the horizontal deflection coil, are separated by a distance d, and auxiliary coils 34 and 35 are provided in a central part of the main coils 32 and 33 lying above and below the horizontal axis of the color TV tube apparatus, and connected electrically in series to the encompassing main coil.

In FIG. 6, the width W and height H of the horizontal coil 30 is 200 mm and 155 mm, respectively, while the width e and height f of the auxiliary coils 34 and 35 is 32 mm and 47 mm, respectively. The widened distance d separating the main coils 32 and 33 is 2 mm, while the non-widened distance separating the main coils 32 and 33 is 0.5 mm.

Figure 7:
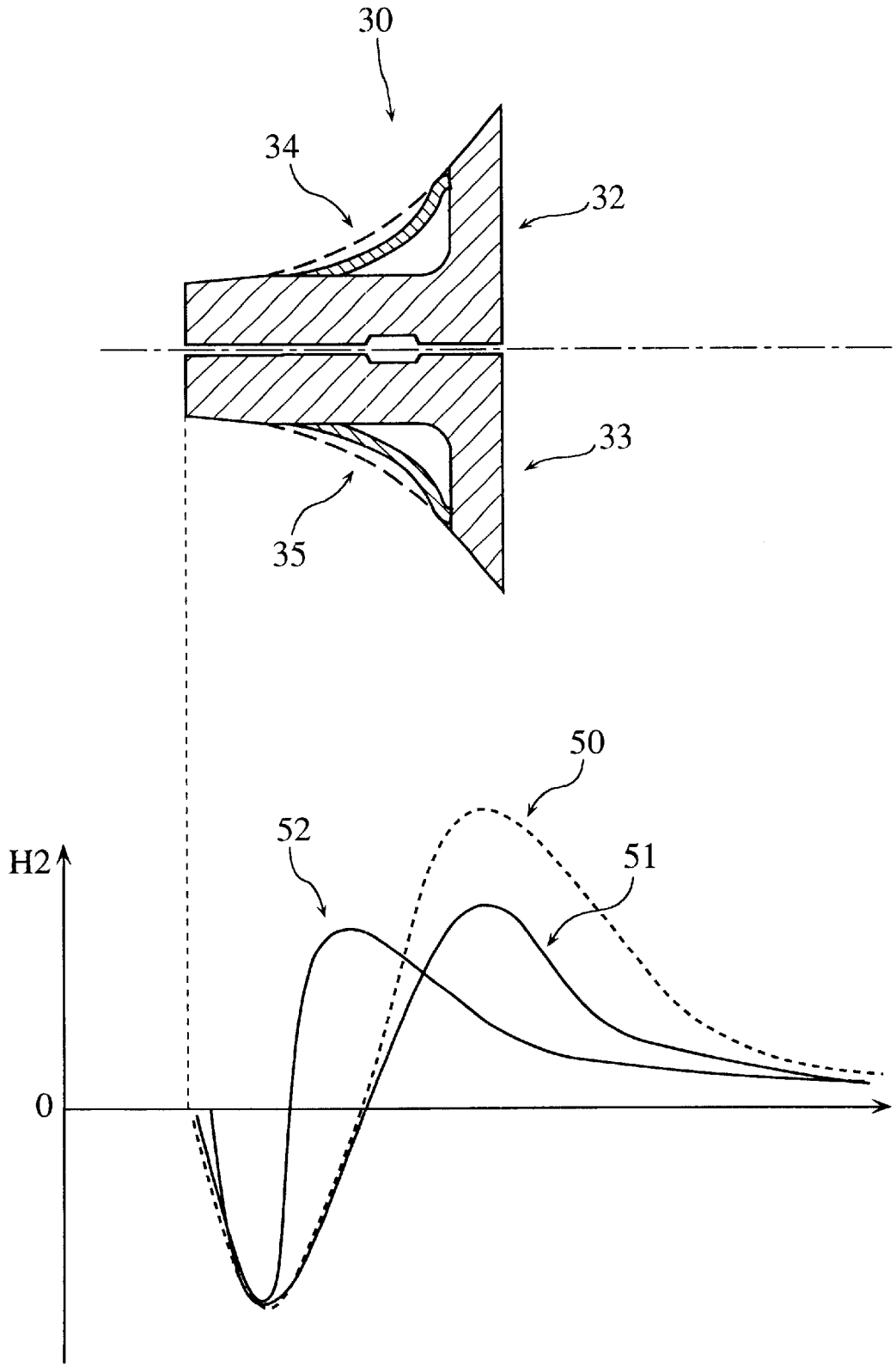
FIG. 7 shows both a profile view of the horizontal deflection coil and a graph representing the degree of horizontal deflection field distortion along the tube axis.

FIG. 7 shows both a profile view of the horizontal deflection coil 30 and a graph representing the degree of horizontal deflection field distortion H2 along the tube axis. In FIG. 7, the vertical axis of the graph represents the horizontal deflection field distortion, while the horizontal axis represents the positioning of the distortion along the tube axis. In the graph, curved-line 52 represents the distortion of the horizontal deflection field H2 in accordance with the specific embodiments of the present invention. In comparison with curved-line 50, representing horizontal deflection field distortion when no space has been opened up between the main coils 32 and 33 and when no auxiliary coils 34 and 35 have been provided, the lower peak of curved-line 52 shows that the distortion has been alleviated.

Curved-line 51 shows the distortion when a space of 2 mm has been opened up between the main coils 32 and 33 but when no auxiliary coils 34 and 35 have been provided. The peak of curved-line 51 is slightly higher than that of curved-line 52 and lower than that of curved-line 50, while the positioning of the peak is roughly the same as that of curved-line 50. Thus it becomes clear that by opening up a space between the main coils 32 and 33 the height of the peak is reduced, and by providing auxiliary coils 34 and 35 the peak is shifted in the direction of the electron gun.

From the above discussion it should be clear that both opening up a space between the main coils 32 and 33 and providing auxiliary coils 34 and 35 in accordance with the specific embodiments of the present invention helps to achieve the objectives of the present invention, which are to reduce the overall distortion of the horizontal deflection field and to improve convergence correction by shifting the peak of the distortion nearer the electron gun. However, the objectives of the present invention can still be achieved by completing only one of the above, i.e., either opening up a space between the main coils or providing auxiliary coils.

The correction coil 31 is a common convergence correction coil comprising four coils. It is positioned in between the horizontal deflection coil 30 and the electron gun 11 and is mounted around a neck part of the color TV tube, as shown in FIG. 4. Each coil is connected electrically to the horizontal deflection coil in series, and convergence is corrected by generating a deflection field that alters in synchronization with alterations to the deflection angle of the electron beams.

Figure 8:
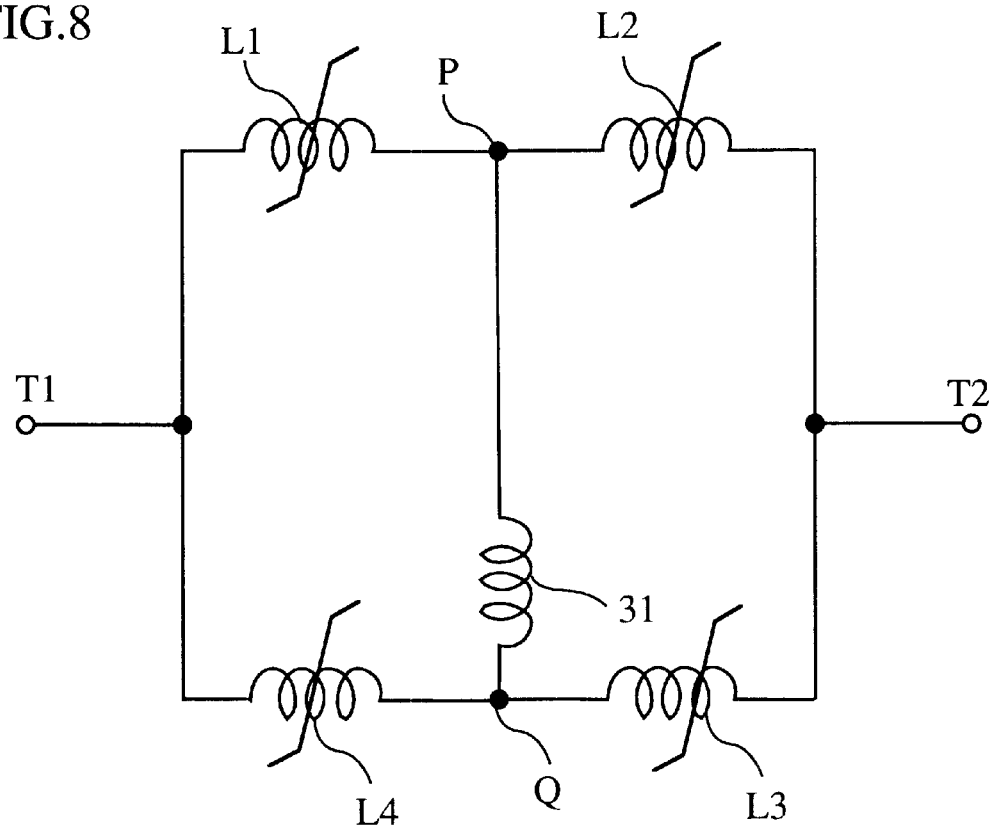
FIG. 8 is a diagram of a correction coil circuit that uses saturable reactors.

The correction coil 31 is connected to the horizontal deflection coil via the circuit shown in FIG. 8 so that the direction of the electric current flowing to the correction coil 31 can be regulated irrespective of the direction of deflection. FIG. 8 is a diagram of a correction coil circuit that uses saturable reactors L1–L4 for the peripheral circuit. In FIG. 8, the correction coil 31 is connected to the peripheral circuit at connection points P and Q, thus form a bridge between the two series circuits L1 and L2, and L3 and L4, which are otherwise connected to each other in parallel.

The circuit shown in FIG. 8 is connected to the horizontal deflection coil 30 at terminal T1. The electric current flows from terminal T1 to terminal T2 when the right-hand side of the display screen is scanned. In this case, the inductance of saturable reactors L1 and L3 rises at the same time as the inductance of saturable reactors L2 and L4 falls, resulting in the electric current flowing from point P to point Q.

Figure 9:
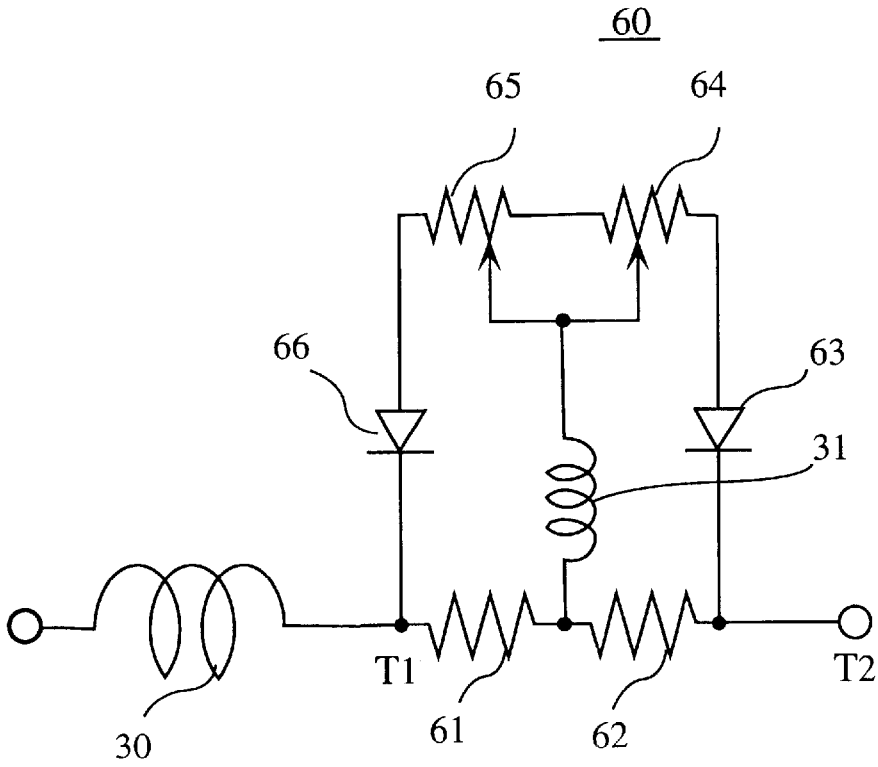
FIG. 9 is a diagram of a correction coil circuit that uses diodes.

In contrast, the electric current flows from terminal T2 to terminal T1 when the left-hand side of the display screen is scanned, leading to a fall in the inductance of saturable reactors L1 and L3 and a rise in the inductance of saturable reactors L2 and L4. However, the direction of the electric current remains unaffected and continues to flow from point P to point Q. From the above it is clear that the direction of the electric current flowing to the correction coil 31 is always from connection point P to connection point Q. As shown in FIG. 9, the result is the same even when the electric current is commuted by replacing the saturable reactors L1, L2, L3 and L4 with resistances 61, 62, 64 and 65 and diodes 63 and 66.

When the horizontal deflection field is distorted in a manner represented by curved-line 52, the electron beams 16–18 are emitted from the electron gun 11 with the lensing action of the electron gun 11 non-operational and no voltage being applied to the correction coil 31. As such, a scan-line image 71 of the type shown in FIG. 10 appears on the display screen of the color TV tube 10 when the electron beams are deflected so that they travel only in a horizontal direction (that is, the electron beams are not deflected in a vertical direction).

Having the lensing action of the electron gun non-operational means that the focusing action of the main focusing lens and quadrupole lens of the electron gun does not function. In terms of the specific embodiments of the present invention, this entails applying the same predetermined focusing voltage to the first focusing electrode 25, the second focusing electrode 26, and the final electrode 27.

Figure 10:
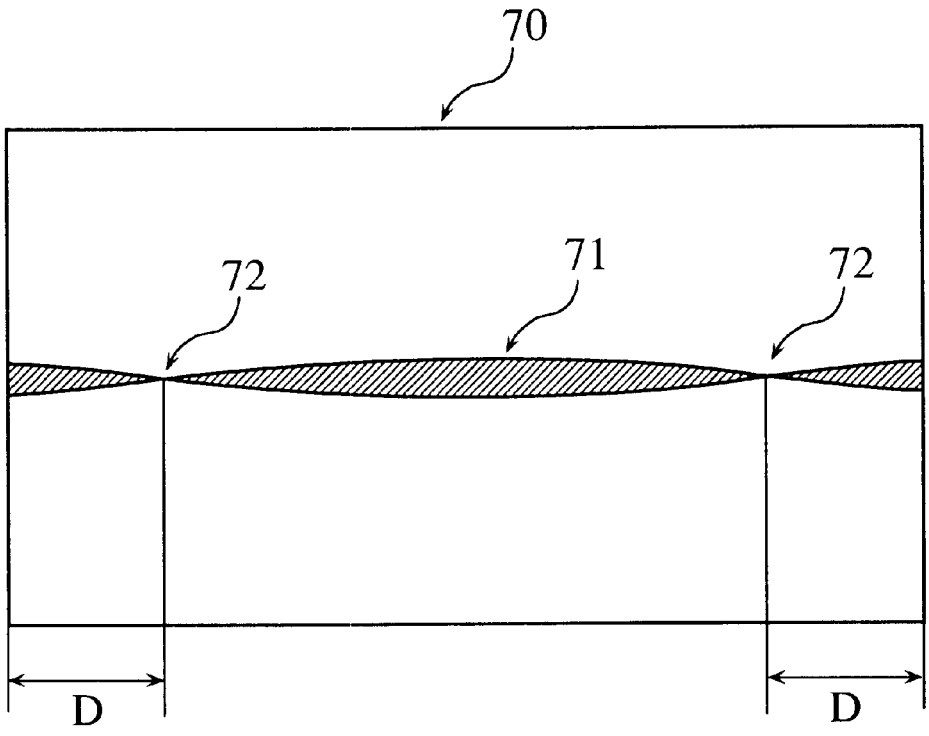
FIG. 10 shows a display screen displaying an image having electromagnetic focus points.

In FIG. 10, the non-uniformity of the width of the scan-line image 71 is due to, (1) the electron beams being subject to electromagnetic focusing arising from horizontal deflection field distortion as mentioned above, and (2) the length of the beam path being shortest at screen center and longer towards the periphery of the screen. In other words, as a result of the electromagnetic focusing arising from horizontal deflection field distortion, there is a certain point along the beam path after it has passed through the deflection zone at which the spot diameter is smallest. Although this focusing distance is not affected by the horizontal deflection angle, the length of the beam path to the phosphor screen is affected thereof. Consequently, the spot diameter of the electron beam on the phosphor screen is smallest when the horizontal deflection angle is such that the length of the beam path to the phosphor screen is equal to the focusing distance generated by electromagnetic focusing.

In FIG. 10, the narrowest points 72 (hereafter, "electromagnetic focus points") of the scan-line image are the points at which the spot diameter of the electron beam is smallest, and the length of the beam path at these points is equal to the focusing distance generated by electromagnetic focusing. Since the length of the beam path to the phosphor screen is shorter at screen center than the focusing distance, the central part of the screen lying between the electromagnetic focus points 72 remains under-focused and the width of the scan-line image is broad. In contrast, the peripheral parts of the screen lying outside of the electromagnetic focus points 72 become over-focused and the width of the scan-line image is broad as a result of the length of the beam path to the phosphor screen being longer than the focusing distance.

The distance D, representing the distance of the electromagnetic focus points 72 from each edge of an effective display screen area 70 along the horizontal axis, is 18–20 mm according to actual measurement. The effective display screen area 70, comprising the entire area of the phosphor screen 15, is the area actually available for image display. Tests have shown that the dynamic focusing voltage applied from the electron gun for the purpose of focus correction is 1–2 kV when the distance D is adjusted to fall within the 18–20 mm range mentioned above. 1–2 kV is a voltage that falls within a practical range.

Misconvergence generating from the alleviation of horizontal deflection field distortion has a largest value of 10–13 mm when expressed in terms of the spread of the electron beams in a horizontal direction on the phosphor screen 15. This is within a range correctable by the correction coil 31. Raster distortion is also within a range correctable by the raster correction circuit.

The distance D widens and misconvergence becomes pronounced when the pincushion distortion of the horizontal deflection field is severe. When the distance D exceeds 50 mm, a voltage of 3 kV or more is required from the electron gun 11 for focus correction, which greatly reduces the lifespan of the electron gun and the peripheral circuits. Such an application is therefore not practical.

If horizontal deflection field distortion is alleviated to a greater extent than that mentioned above, the misconvergence towards screen center is reduced, while the misconvergence towards each edge of screen along the horizontal axis becomes accentuated. The problem here is that correcting convergence at each edge of the display screen leads to over-correction and subsequent misconvergence at screen center. Furthermore, misconvergence after correction by the correction coil must be kept at 0.5 mm or below since misconvergence exceeding 0.5 mm is visible to the human eye.

Figure 11:
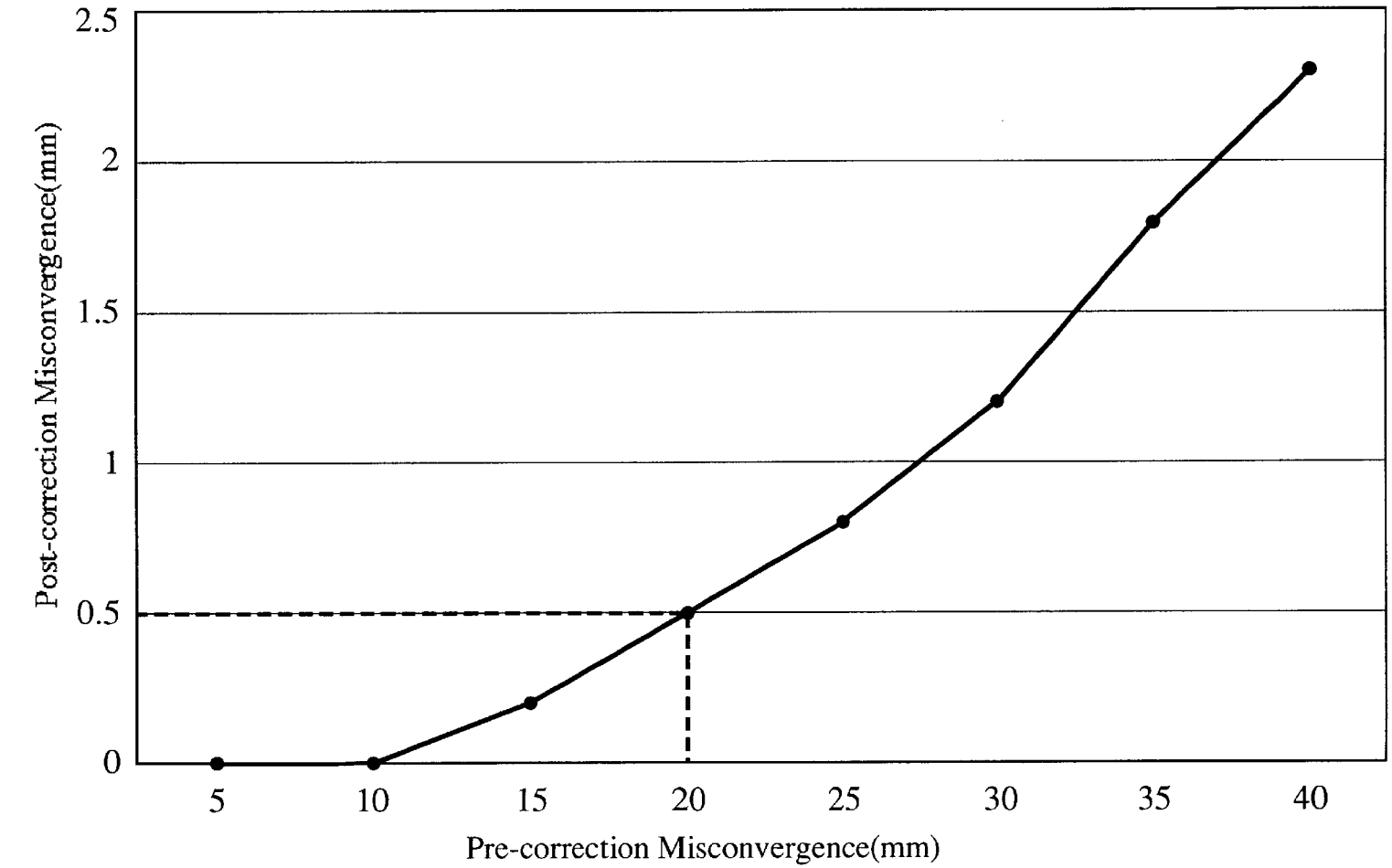
FIG. 11 is a graph showing the relationship between misconvergence before and after correction by the correction coil.

FIG. 11 is a graph plotting the relationship between misconvergence before correction by the correction coil and misconvergence after correction by the correction coil. Misconvergence before correction by the correction coil refers to misconvergence expressed in terms of the spread of the electron beams in a horizontal direction occurring at each edge along the horizontal axis of the display screen. As can be seen from FIG. 11, it is desirable to keep the misconvergence pre-correction at 20 mm or below, since misconvergence post-correction exceeds 0.5 mm when misconvergence pre-correction exceeds 20 mm. When the electromagnetic focus points exceed the edge of the effective display screen area along the horizontal axis by 40 mm or more, pre-correction misconvergence exceeds 20 mm and post-correction misconvergence exceeds 0.5 mm. Such an application is therefore not practical since image quality is noticeably reduced.

From the above it is clear that, with respect to a 32 inch color TV tube apparatus with a maximum deflection angle of 124°, the dynamic focusing voltage applied to the electron gun as well as the effect of correction by the correction coil is optimized, excellent convergence and focusing across the entire screen is realized, and raster distortion is prevented when horizontal deflection field distortion is alleviated so that the distance D falls within the range 18–20 mm.

While the above discussion refers to a 32 inch color TV tube apparatus with a 16:9 aspect ratio and 124° maximum deflection angle in accordance with the specific embodiments of the present invention, experiment data relating to color TV tube apparatus of various sizes has been tabulated and presented in FIG. 12. Specifically, the data shows that the distance D for a 28 inch color TV tube apparatus is 32–35 mm, and that the distance D from a 36 inch color TV tube apparatus is 3–5 mm.

Generally speaking, a practical image quality is achievable when the electromagnetic focus points fall within a −30–50 mm range with respect to 28–36 inch color TV tube apparatus with a 16:9 aspect ratio and a maximum deflection angle of 115° or greater. Also, with respect to 17–21 inch color display tube apparatus having a maximum deflection angle of 105° or greater, it is desirable to have the electromagnetic focus points fall within a −50–20 mm range.

In accordance with the specific embodiments of the present invention, the optimal distortion of the horizontal deflection field was evaluated above using the positioning of the electromagnetic focus points as a basis, although it is also possible to conduct the same evaluation using misconvergence before correction by the convergence correction coil as a basis. In this case, it is desirable to keep misconvergence within a 5–20 mm range with respect to a 28–36 inch color TV tube apparatus having a 16:9 aspect ratio and a maximum deflection angle of 115° or greater, and within a 3–15 mm range with respect to a 17–21 inch color display tube apparatus having a maximum deflection angle of 105° or greater.

When the electromagnetic focus points lie within the effective display screen area (as in FIG. 10), the distance between an electromagnetic focus point and an edge of the effective display screen area along the horizontal axis can be readily measured. However, when the electromagnetic focus points lie outside the effective display screen area, one of the following three methods of measurement must be used since the electromagnetic focus points are not readily visible.

One method involves rotating a magnet, being a color-purified magnet (commonly referred to as a purity magnet), which is commonly mounted in color CRT apparatus. The color-purified magnet takes the form of a pair of annular magnets that are mounted around a neck part of CRT apparatus. Each of the magnets that comprise the color-purified magnet form a pair of magnetic poles opposing each other at the ring center.

With the deflection of the electron beams by the deflection coil non-operational (hereafter referred to as "non-deflection conditions"), it is possible to deflect the electron beams in a horizontal direction by rotating the color-purified magnet. Using this method, the required measurement can be obtained by (1) marking the position of the beam spot at screen center under non-deflection conditions, (2) rotating the color-purified magnet until the electromagnetic focus point appears at the edge of the effective display screen area, and (3) again under non-deflection conditions, measuring the distance between the marked position of the beam spot at screen center and the position of the beam spot after the color-purified magnet has been rotated.

A second method involves calculating the position of the electromagnetic focus points by measuring the horizontal width of the elongated image that is displayed when horizontal deflection is conducted with the lensing action of the electron gun and the correction action of the correction coil non-operational. Specifically, by locating the points at which this elongated image is at its widest and narrowest and then drawing a line that connects the two upper and lower points, respectively, it is possible to determine the position of the electromagnetic focus point by considering the intersection of these two lines to be the electromagnetic focus point.

A further method involves applying a phosphorous substance to the area outside the edges of the effective display screen area during the manufacture of the color CRT apparatus, as this enables the position of the electromagnetic focus points to be determined visually.

In accordance with the specific embodiments of the present invention, the width of the space opened up between a pair of main coils that comprise the horizontal deflection coil is fixed and uniform along the entire length thereof. This space need not, however, necessarily be either fixed or uniform. When only a partial space is opened up between the two coils along the length thereof it becomes possible to alter the positioning of the peak of the horizontal deflection field distortion by altering the positioning of the space. Also, it is possible to move the peak of the horizontal deflection field distortion closer to the electron gun by positioning the above-mentioned auxiliary coils closer to the electron gun, and to move the peak further away from the electron gun by positioning the auxiliary coils further away from the electron gun.

Although the above discussion relates to a color TV tube apparatus having a 16:9 aspect ratio in accordance with the specific embodiments of the present invention, the present invention is also applicable to a color CRT apparatus having a 4:3 aspect ratio.

One method to alleviate pincushion distortion of the horizontal deflection field without reducing the effectiveness of the present invention is to widen the distance separating the two main coils in the manner discussed above. Another method involves reducing the density of the wrapping of each of the main coils in the area where the periphery of each of the main coils comes in close proximity along the horizontal axis of the color TV tube apparatus.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A color TV tube apparatus, being of 28 inches or larger in diagonal size, having a maximum deflection angle of 115° or greater and less than 180°, and which uses a self-convergence method, the color TV tube apparatus comprising:

a color TV tube;

an electron gun;

a deflection yoke, being mounted on a funnel part of the color TV tube and having a horizontal deflection coil for generating a pincushion-shaped horizontal deflection field, wherein the horizontal deflection coil is adjusted so that a vertical focus point of an electron beam lies 50 mm or less on the inside and 30 mm or less on the outside of each edge of the effective display screen area along the horizontal axis with a focusing of an electron beam by a lensing action of the electron gun non-operational; and a convergence correction coil, being mounted on a neck part of the color TV tube and functioning to correct convergence.

2. The color TV tube apparatus of claim 1, wherein the convergence correction coil is connected electrically to the horizontal deflection coil and functions to correct convergence in synchronization with a horizontal deflection action.

3. The color TV tube apparatus of claim 1, wherein the horizontal deflection coil is adjusted by widening at least part of an area between a pair of main coils that comprise the horizontal deflection coil, the area being where the periphery of each of the main coils comes in close proximity.

4. The color TV tube apparatus of claim 1, wherein the horizontal deflection coil is adjusted by providing a pair of auxiliary coils, each auxiliary coil being positioned in a horizontally central part of one of the main coils and connected electrically in series to the encompassing main coil.

5. A color TV tube apparatus of 28 inches or larger in diagonal size, having a maximum deflection angle of 115° or greater and less than 180°, and which uses a self-convergence method, the color TV tube apparatus comprising:

a color TV tube;

a deflection yoke, being mounted on the funnel part of the color TV tube and having a horizontal deflection coil for generating a pincushion-shaped horizontal deflection field, wherein the horizontal deflection coil is adjusted such that misconvergence, expressed in terms of the spread of the electron beams in a horizontal direction, occurring at each edge of the effective display screen area along the horizontal axis is 5 mm or more and 20 mm or less; and a convergence correction coil, being mounted on the neck part of the color TV tube and functioning to correct convergence so as to eliminate the misconvergence.

6. The color TV tube apparatus of claim 5, wherein the convergence correction coil is connected electrically to the horizontal deflection coil and functions to correct convergence in synchronization with a horizontal deflection action.

7. The color TV tube apparatus of claim 5, wherein the horizontal deflection coil is adjusted by widening at least part of an area between a pair of main coils that comprise the horizontal deflection coil, the area being where the periphery of each of the main coils comes in close proximity.

8. The color TV tube apparatus of claim 5, wherein the horizontal deflection coil is adjusted by providing a pair of auxiliary coils, each auxiliary coil being positioned in a horizontally central part of one of the main coils and connected electrically in series to the encompassing main coil.

9. A color display tube apparatus of 17 inches or larger in diagonal size, having a maximum deflection angle of 105° or more and less than 180°, and which uses a self-convergence method, the color display tube apparatus comprising:

a color display tube;

an electron gun;

a deflection yoke, being mounted on a funnel part of the color display tube and having a horizontal deflection coil for generating a pincushion-shaped horizontal deflection field, wherein the horizontal deflection coil is adjusted so that a vertical focus point of an electron beam lies 20 mm or less on the inside and 50 mm or less on the outside of each edge of the effective display screen area along the horizontal axis with the focusing of an electron beam by a lensing action of the electron gun non-operational; and a convergence correction coil, being mounted on the neck part of the color display tube and functioning to correct convergence.

10. The color display tube apparatus of claim 9, wherein the convergence correction coil is connected electrically to the horizontal deflection coil and functions to correct convergence in synchronization with a horizontal deflection action.

11. The color TV display tube apparatus of claim 9, wherein the horizontal deflection coil is adjusted by widening at least part of an area between a pair of main coils that comprise the horizontal deflection coil, the area being where the periphery of each of the main coils comes in close proximity.

12. The color display tube apparatus of claim 9, wherein the horizontal deflection coil is adjusted by providing a pair of auxiliary coils, each auxiliary coil being positioned in a horizontally central part of one of the main coils and connected electrically in series to the encompassing main coil.

13. A color display tube apparatus of 17 inches or larger in diagonal size, having a maximum deflection angle of 105° or greater and less than 180°, and which uses a self-convergence method, the color display tube apparatus comprising:

a color display tube;

a deflection yoke, being mounted on the funnel part of the color display tube and having a horizontal deflection coil for generating a pincushion-shaped horizontal deflection field, wherein the horizontal deflection coil is adjusted such that misconvergence, expressed in terms of the spread of the electron beams in a horizontal direction, occurring at each edge of the effective display screen area along the horizontal axis is 3 mm or more and 15 mm or less; and a convergence correction coil, being mounted on the neck part of the color TV tube and functioning to correct convergence so as to eliminate the misconvergence.

14. The color TV tube apparatus of claim 1, wherein the convergence correction coil is connected electrically to the horizontal deflection coil and functions to correct convergence in synchronization with a horizontal deflection action.

15. The color display tube apparatus of claim 13, wherein the horizontal deflection coil is a adjusted by widening at least part of an area between a pair of main coils that comprise the horizontal deflection coil, the are being where the periphery of each of the main coils comes in close proximity.

16. The color display tube apparatus of claim 13, wherein the horizontal deflection coil is adjusted by providing a pair of auxiliary coils, each auxiliary coil being positioned in a horizontally central part of one of the main coils and connected electrically in series to the encompassing main coil.

* * * * *